US010242782B2

(12) United States Patent
Toda et al.

(10) Patent No.: US 10,242,782 B2
(45) Date of Patent: Mar. 26, 2019

(54) HIGH-STRENGTH ELECTRICAL STEEL SHEET AND METHOD OF PRODUCING THE SAME

(75) Inventors: Hiroaki Toda, Tokyo (JP); Tadashi Nakanishi, Tokyo (JP); Masaaki Kohno, Tokyo (JP); Yoshihiko Oda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 436 days.

(21) Appl. No.: 14/413,658

(22) PCT Filed: Aug. 8, 2012

(86) PCT No.: PCT/JP2012/005046
§ 371 (c)(1),
(2), (4) Date: Jan. 8, 2015

(87) PCT Pub. No.: WO2014/024222
PCT Pub. Date: Feb. 13, 2014

(65) Prior Publication Data
US 2015/0213928 A1 Jul. 30, 2015

(51) Int. Cl.
*H01F 1/16* (2006.01)
*C22C 38/06* (2006.01)
(Continued)

(52) U.S. Cl.
CPC ..... *H01F 1/16* (2013.01); *C21D 1/76* (2013.01); *C21D 6/002* (2013.01); *C21D 6/005* (2013.01);
(Continued)

(58) Field of Classification Search
CPC ..... C21D 8/1272; C22C 38/00; H01F 1/16
(Continued)

(56) References Cited

U.S. PATENT DOCUMENTS 6,942,740 B2 * 9/2005 Hayakawa ..... C21D 8/1272 148/307
8,936,687 B2 * 1/2015 Sadahiro ..... B21B 3/02 148/111
(Continued)

FOREIGN PATENT DOCUMENTS

CN 1400319 A 3/2003
CN 102226251 A 10/2011
(Continued)

OTHER PUBLICATIONS

Dec. 2, 2015 Office Action issued in Chinese Patent Application No. 201280075133.4.
(Continued)

*Primary Examiner* — Jie Yang
(74) *Attorney, Agent, or Firm* — Oliff PLC

(57) ABSTRACT

According to the present invention, a high-strength electrical steel sheet that is suitable as rotor material for a high speed motor, steadily has high strength, and also has excellent magnetic properties can be obtained by setting the chemical composition thereof to include, by mass %, C: 0.005% or less, Si: more than 3.5% and 4.5% or less, Mn: 0.01% or more and 0.10% or less, Al: 0.005% or less, Ca: 0.0010% or more and 0.0050% or less, S: 0.0030% or less, and N: 0.0030% or less, Ca/S being 0.80 or more, the balance being Fe and incidental impurities, and by setting the sheet thickness to 0.40 mm or less, the non-recrystallized deformed microstructure to 10% or more and 70% or less, tensile strength (TS) to 600 MPa or more, and iron loss $W_{10/400}$ to 30 W/kg or less.

4 Claims, 7 Drawing Sheets

(51) Int. Cl.

| | |
|---|---|
| ***C22C 38/60*** | (2006.01) |
| ***C21D 1/76*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C21D 6/00*** | (2006.01) |
| ***C21D 8/02*** | (2006.01) |
| ***C21D 9/46*** | (2006.01) |
| ***C22C 38/12*** | (2006.01) |
| ***C22C 38/32*** | (2006.01) |
| ***C22C 38/34*** | (2006.01) |

(52) U.S. Cl.
CPC ..... *C21D 6/008* (2013.01); *C21D 8/0236* (2013.01); *C21D 8/0263* (2013.01); *C21D 8/1222* (2013.01); *C21D 8/1272* (2013.01); *C21D 9/46* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/12* (2013.01); *C22C 38/32* (2013.01); *C22C 38/34* (2013.01); *C22C 38/60* (2013.01); *C21D 8/1233* (2013.01); *C21D 8/1261* (2013.01); *C21D 8/1283* (2013.01)

(58) Field of Classification Search
USPC ..... 148/111
See application file for complete search history.

(56) References Cited

U.S. PATENT DOCUMENTS

| | | | |
|---|---|---|---|
| 9,051,622 | B2 | 6/2015 | Arai et al. |
| 9,595,376 | B2 | 3/2017 | Miyazaki et al. |
| 2003/0116236 | A1 | 6/2003 | Hayakawa et al. |
| 2009/0202383 | A1 | 8/2009 | Tanaka et al. |
| 2012/0009436 | A1 | 1/2012 | Arai et al. |
| 2012/0014828 | A1 | 1/2012 | Miyazaki et al. |
| 2015/0059929 | A1 | 3/2015 | Zaizen et al. |
| 2015/0136278 | A1 | 5/2015 | Nakanishi et al. |
| 2015/0270042 | A1 | 9/2015 | Toda et al. |

FOREIGN PATENT DOCUMENTS

| | | | |
|---|---|---|---|
| EP | 1 081 238 | A2 | 3/2001 |
| EP | 1 273 673 | A1 | 1/2003 |
| JP | S60238421 | A | 11/1985 |
| JP | S62112723 | A | 5/1987 |
| JP | H028346 | A | 1/1990 |
| JP | H0222442 | A | 1/1990 |
| JP | H04337050 | A | 11/1992 |
| JP | H06330255 | A | 11/1994 |
| JP | H1161260 | A | 3/1999 |
| JP | H11293426 | A | 10/1999 |
| JP | 2000-219917 | A | 8/2000 |
| JP | 2001271147 | A | 10/2001 |
| JP | 2001-348652 | A | 12/2001 |
| JP | 2004-183066 | A | 7/2004 |
| JP | 2004-277760 | A | 10/2004 |
| JP | 2005113185 | A | 4/2005 |
| JP | 2005-200713 | A | 7/2005 |
| JP | 2005264315 | A | 9/2005 |
| JP | 2006169611 | A | 6/2006 |
| JP | 2007-154271 | A | 6/2007 |
| JP | 2007186790 | A | 7/2007 |
| JP | 4126479 | B2 | 7/2008 |
| JP | 2009167480 | A | 7/2009 |
| JP | 2010090474 | A | 4/2010 |
| JP | 2012136763 | A | 7/2012 |
| JP | 2012136764 | A | 7/2012 |
| JP | 2012140676 | A | 7/2012 |
| JP | 2012149337 | A | 8/2012 |
| KR | 20000001997 | A | 1/2000 |
| TW | 201038750 | A | 11/2010 |
| TW | 201105807 | A | 2/2011 |
| WO | 2006/068399 | A1 | 6/2006 |
| WO | 2013/054514 | A1 | 4/2013 |
| WO | 2013/137092 | A1 | 9/2013 |
| WO | 2014/027452 | A1 | 2/2014 |
| WO | 2014/061246 | A1 | 4/2014 |

OTHER PUBLICATIONS

Dec. 3, 2015 Office Action issued in Korean Patent Application No. 10-2005-7005063.
Database WPI; XP002745642; Week 201250; Thomson Scientific, London, GB; AN 2012-J58522.
Database WPI; XP002745643; Week 201248; Thomson Scientific, London, GB; AN 2012-J36221.
Database WPI; XP002745644; Week 201248; Thomson Scientific, London, GB; AN 2012-J36898.
Oct. 19, 2015 extended Search Report issued in European Patent Application No. 12882849.8.
Aug. 15, 2016 Office Action issued in Chinese Patent Application No. 201280075133.4.
Jun. 15, 2018 Office Action issued in U.S. Appl. No. 15/500,435.
Nov. 6, 2012 International Search Report issued in Japanese Patent Application No. PCT/JP2012/005046.
May 4, 2017 Office Action issued in U.S. Appl. No. 14/435,314.
Jan. 4, 2018 Office Action issued in Chinese Patent Application No. 201610956074.1.
Sep. 11, 2018 Office Action issued in Chinese Patent Application No. 201610956074.1.

* cited by examiner

HIGH-STRENGTH ELECTRICAL STEEL SHEET AND METHOD OF PRODUCING THE SAME

TECHNICAL FIELD

The present invention relates to a non-oriented electrical steel sheet. In particular, the present invention relates to a high-strength electrical (electromagnetic) steel sheet, and a method of producing the same, that has excellent magnetic properties, and is suitable for use in a component to which a large stress is applied, a typical example of which is the rotor in high-speed rotating machinery such as a turbine generator, a drive motor of an electric vehicle or a hybrid vehicle, a motor for a machine tool, or the like.

BACKGROUND ART

With the development of motor drive systems in recent years, frequency control of the driving power source has become possible, and motors increasingly operate at variable speed or rotate at high speed at or above commercial frequency. In such motors that rotate at high speed, the centrifugal force acting on the rotating body, such as a rotor, grows large proportional to the radius of rotation, in proportion to the square of the rotational speed. Hence, high-strength material needs to be used as the rotor material, in particular for a medium or large-sized high-speed motor.

Furthermore, in recent years, slits in which magnets are embedded are provided along the outer periphery of the rotor in an IPM (Interior Permanent Magnet)-type DC inverter control motor, which is increasingly being used as, for example, a drive motor or a compressor motor in a hybrid vehicle. Therefore, due to the centrifugal force during high-speed rotation of the motor, stress concentrates on the narrow bridge (such as the portion between the rotor periphery and the slits). Moreover, since the stress state varies due to acceleration and deceleration of the motor and due to vibration, the core material used in the rotor not only needs to be high strength but also needs to have a high fatigue strength.

Additionally, in a high speed motor, eddy current occurs due to high-frequency magnetic flux, both reducing the motor efficiency and generating heat. When the amount of generated heat grows large, the magnets embedded in the rotor are demagnetized. A low iron loss in the high-frequency range is thus also desired.

Accordingly, as the material for a rotor, there is a demand for an electrical steel sheet that has excellent magnetic properties and is high strength.

Solid solution strengthening, strengthening by precipitation, strengthening by crystal grain refinement, and multiphase strengthening are known as methods for strengthening steel sheets, yet many of these strengthening methods cause magnetic properties to degrade. Therefore, typically it is extremely difficult to make strengthening compatible with magnetic properties.

In such circumstances, several proposals have been made regarding high-tension electrical steel sheets.

For example, JP S60-238421 A (PTL 1) proposes a method for strengthening by increasing the Si content to 3.5% to 7.0% and adding elements such as Ti, W, Mo, Mn, Ni, Co, and Al for solid solution strengthening.

In addition to the above strengthening method, JP S62-112723 A (PTL 2) proposes a method for improving magnetic properties by setting the crystal grain diameter to 0.01 mm to 5.0 mm by adjusting the final annealing conditions.

When these methods are applied to factory production, however, problems such as sheet breakage occur more easily in the continuous annealing step after hot rolling, the subsequent rolling step, and the like, leading to problems such as reduced yield or the need to shut down the production line.

To address this issue, performing warm rolling with a sheet temperature of several hundred ° C. instead of cold rolling reduces sheet breakage. Equipment for warm rolling becomes necessary, however, and serious process control problems also occur, such as severe restrictions on production.

JP H02-022442 A (PTL 3) proposes a method for solid solution strengthening that adds Mn or Ni to steel with a Si content of 2.0% to 3.5%. JP H02-008346 A (PTL 4) proposes a technique for making high strength compatible with magnetic properties by solid solution strengthening that adds Mn or Ni to steel with a Si content of 2.0% to 4.0% and furthermore by using carbonitrides of Nb, Zr, Ti. V, and the like. JP H06-330255 A (PTL 5) proposes a technique for making high strength compatible with magnetic properties by using a precipitation effect and a grain refinement effect due to carbonitrides of Nb, Zr, Ti, V and the like in steel with a Si content of 2.0% or more and less than 4.0%.

These methods, however, have the problem of a higher cost because of the addition of a large amount of expensive elements, such as Ni, and because of reduced yield due to an increase in defects such as scab. Furthermore, these disclosed techniques use a precipitation effect due to carbonitrides and therefore have the problem of a large degradation in magnetic properties.

JP H04-337050 A (PTL 6) discloses a technique for increasing steel sheet strength by setting the recrystallization rate of the crystallized microstructure to be 95% or less and the balance to be effectively a rolled microstructure by heat treatment, at a specific temperature prescribed by the relationship with the Si content, of a cold-rolled steel sheet having a chemical composition of Si: 4.0% to 7.0%.

With the above technique, for example when performing heat treatment at 700° C., it becomes necessary to add at least approximately 5.9% of Si, yet the result is a practical soft magnetic material that has tensile strength as high as 80 $kgf/mm^2$ or more and a desired elongation and that is also provided with excellent magnetic properties.

For an electrical steel sheet that includes Si: 0.2% to 4.0% and has a ferrite phase as the main phase, JP 2005-264315 A (PTL 7) discloses a technique for increasing steel sheet strength by adding Ti, Nb, Ni, and the like and by generating intermetallic compounds having a diameter of 0.050 μm or less inside the steel material. With this method, a non-oriented electrical steel sheet that has tensile strength of 60 $kgf/mm^2$ or more, abrasion resistance, and excellent magnetic flux density and iron loss properties can be manufactured without detriment to cold rolling manufacturability or the like.

Furthermore, JP 2005-113185 A (PTL 8), JP 2006-169611 A (PTL 9), and JP 2007-186790 A (PTL 10) propose a high-strength electrical steel sheet in which a non-recrystallized microstructure is made to remain in the steel sheet. With these methods, a high strength can be obtained relatively easily while maintaining manufacturability after hot rolling.

Each of these materials, however, has the problem of variance in the steel sheet strength tending to increase in the direction orthogonal to the rolling direction.

Therefore, JP 2010-090474 A (PTL 11) proposes a method for producing a high-strength non-oriented electrical steel sheet using a slab for which the chemical composition is adjusted to include Si: over 3.5% and 5.0% or less, Al: 0.5% or less, P: 0.20% or less, S: 0.002% or more and 0.005% or less, and N: 0.010% or less, and adjusted so that Mn is in a range satisfying the following relationship with respect to the S amount (mass %):

$$(5.94\times10^{-5})/(S\ \%)\leq Mn\ \%\leq(4.47\times10^{-4})/(S\ \%).$$

With this technique as well, however, the variation in steel sheet strength cannot be considered to be at a desired value for actual use. As before, demand exists for an electrical steel sheet that has low iron loss and that exhibits little variation in strength while being high strength.

CITATION LIST

Patent Literature

PTL 1: JP S60-238421 A
PTL 2: JP S62-112723 A
PTL 3: JP H02-022442 A
PTL 4: JP H02-008346 A
PTL 5: JP H06-330255 A
PTL 6: JP H04-337050 A
PTL 7: JP 2005-264315 A
PTL 8: JP 2005-113185 A
PTL 9: JP 2006-169611 A
PTL 10: JP 2007-186790 A
PTL 11: JP 2010-090474 A
PTL 12: JP 2001-271147 A
PTL 13: JP H11-293426 A

SUMMARY OF INVENTION

Technical Problem

The present invention has been conceived in light of the above circumstances and proposes an electrical steel sheet, and an advantageous method for producing the same, that is suitable as rotor material for a high speed motor, steadily has high strength, and also has excellent magnetic properties.

Solution to Problem

In order to resolve the above-described problems, the inventors of the present invention closely examined the mechanical strength of a high-strength electrical steel sheet that utilizes a non-recrystallized and recovered microstructure, endeavoring to discover the cause of variation in the mechanical strength.

As a result, the inventors discovered that the form in which the non-recrystallized and recovered microstructure and inclusions exist in the steel sheet greatly affects the variation in mechanical strength and also discovered the control conditions on the steel composition and the steel microstructure in order to achieve, with good manufacturability, an electrical steel sheet that combines low iron loss with steady high strength, thereby completing the present invention.

The present invention is based on the aforementioned findings.

Specifically, primary features of the present invention are as follows.

1. An electrical steel sheet, a chemical composition thereof comprising, by mass %, C: 0.005% or less, Si: more than 3.5% and 4.5% or less, Mn: 0.01% or more and 0.10% or less, Al: 0.005% or less, Ca: 0.0010% or more and 0.0050% or less, S: 0.0030% or less, and N: 0.0030% or less, Ca/S being 0.80 or more, the balance being Fe and incidental impurities, a sheet thickness being 0.40 mm or less, a non-recrystallized deformed microstructure being 10% or more and 70% or less, tensile strength (TS) being 600 MPa or more, and iron loss $W_{10/400}$ being 30 W/kg or less.

2. The electrical steel sheet according to 1., the chemical composition thereof further comprising, by mass %, at least one selected from the group consisting of Sb: 0.005% or more and 0.2% or less, Sn: 0.005% or more and 0.2% or less, P: 0.01% or more and 0.2% or less, Mo: 0.005% or more and 0.10% or less, B: 0.0002% or more and 0.002% or less, and Cr: 0.05% or more and 0.5% or less.

3. A method of producing an electrical steel sheet comprising a series of processes including heating and then hot rolling a slab having the chemical composition according to 1. or 2. to obtain a hot-rolled sheet, subsequently coiling and subjecting the sheet to hot band annealing and pickling, then performing cold or warm rolling to yield a sheet thickness of 0.40 mm or less, and then subjecting the sheet to final annealing:

a temperature during the heating of the slab being 1050° C. or higher and 1150° C. or lower, a finisher delivery temperature in the hot rolling being 800° C. or higher and 900° C. or lower, a temperature for the coiling being 500° C. or higher and 650° C. or lower, a temperature for the hot band annealing being 900° C. or higher and 1000° C. or lower, and the final annealing being performed in an atmosphere containing 10 vol % or more of hydrogen and having a dew point of −20° C. or lower, and in a temperature range from over 650° C. to less than 800° C.

Advantageous Effect of Invention

According to the present invention, a high-strength electrical steel sheet with low iron loss can be obtained with good manufacturability.

BRIEF DESCRIPTION OF DRAWINGS

The present invention will be further described below with reference to the accompanying drawings, wherein.

DESCRIPTION OF EMBODIMENTS

Figure 1:
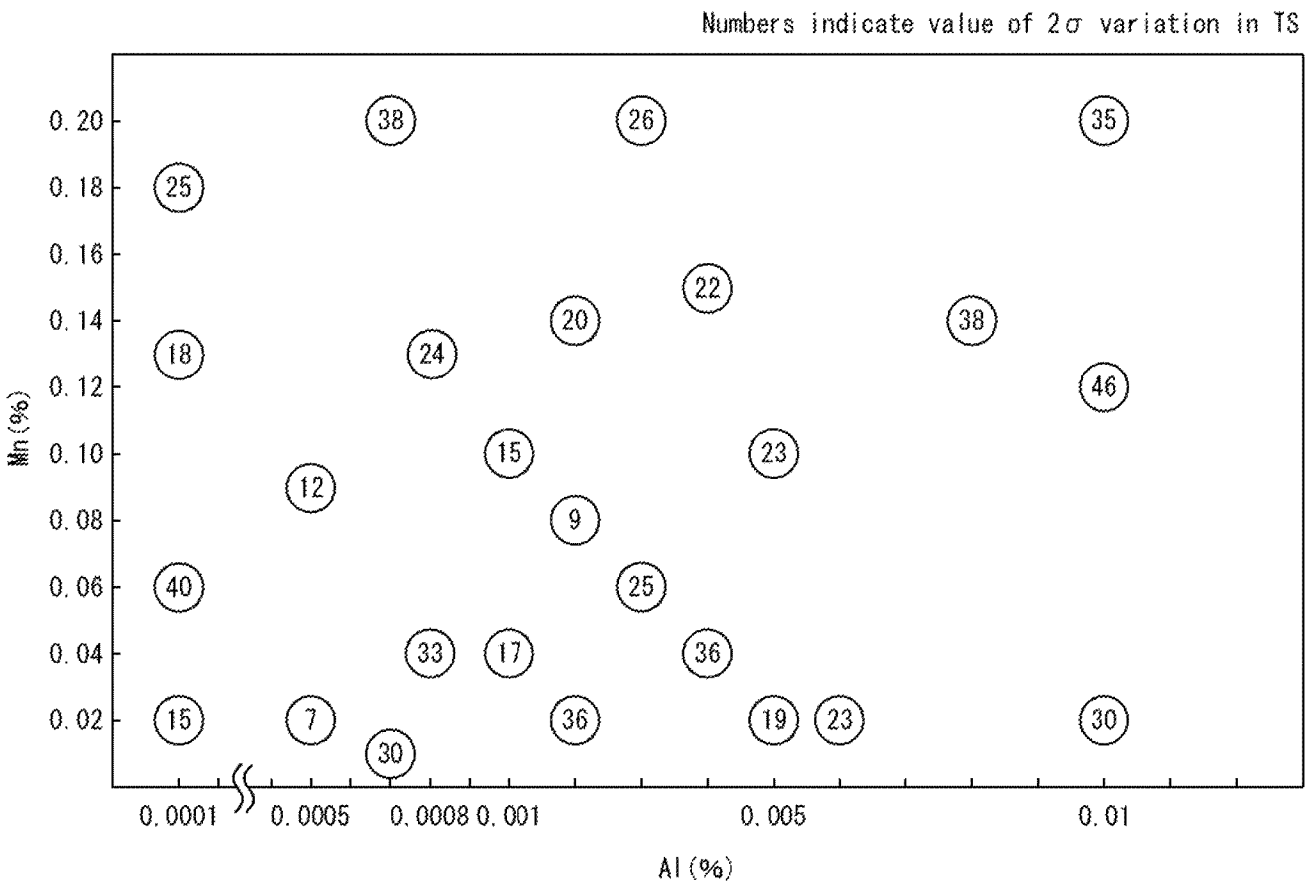
FIG. 1 is a graph showing the relationship between Al and Mn content and 2σ variation in tensile strength.

The present invention is described in detail below. Note that the percentages indicated in the steel sheet composition listed below represent mass % unless otherwise specified.

As described above, when considering the use of carbonitrides of Nb, Zr, Ti, V and the like as means for obtaining a high-strength non-oriented electrical steel sheet, precipitates of carbonitrides or the like obstruct domain wall displacement when the steel sheet is magnetized. Therefore, such precipitates are considered to be intrinsically disadvantageous for achieving low iron loss.

Therefore, the inventors focused on using a non-recrystallized and recovered microstructure as means for strengthening a steel sheet without using precipitates of carbonitrides or the like. When using a non-recrystallized microstructure with a conventional method, however, variation in the form in which the non-recrystallized microstructure exists within the steel sheet tends to have a great effect on variation in mechanical strength. The reason is thought to be that at the time of final annealing, since annealing terminates at an intermediate stage of the recrystallization that is in progress in the steel microstructure, a slight difference in various conditions, such as the initial grain size of the steel sheet, the amount and shape of precipitates, the degree of dislocation introduced at the time of cold rolling, and the like greatly affects the extent of recrystallization.

Accordingly, it is thought that if the above conditions can be made as uniform as possible without variation even at the micro level, the shape of the resulting non-recrystallized microstructure will stabilize. The inventors therefore first examined the material composition.

It is often the case with normal non-oriented electrical steel sheets that elements such as Al or Mn are added in addition to Si for the purpose of reducing iron loss. In particular, Al is added actively since it has a significant effect on increasing specific resistance, as is the case with Si. Mn also has the effect of increasing specific resistance and is effective for suppressing hot shortness. Therefore, Mn is normally added in an amount of approximately 0.15% to 0.20%.

The inventors considered Si to be more useful, however, for achieving the high strength that is the objective of the present invention and first examined a chemical composition mainly using Si and using Al in a supplementary manner.

Steel slabs formed with the chemical compositions listed in Table 1 were heated at 1100° C., then hot rolled to yield hot-rolled sheets with a thickness of 2.0 mm. The sheets were then subjected to hot band annealing at a temperature of 950° C. Next, the sheets were subjected to pickling, then cold rolled to a sheet thickness of 0.35 mm and subsequently subjected to final annealing at a temperature of 750° C.

Epstein test pieces were cut from each of the steel sheets thus obtained in the rolling direction (L) and a direction orthogonal to the rolling direction (C) to measure its magnetic properties. The magnetic properties were assessed in terms of an L+C property (average of L+C). Ten JIS 5 tensile test pieces each were collected in the direction orthogonal to the rolling direction, and a tensile test was performed.

Table 2 lists the obtained results. Variation in the tensile strength (also referred to below as variation in strength or simply as variation) was assessed in terms of the standard deviation a and listed in Table 2 as 2σ.

[Table 1]

TABLE 1

| | Chemical composition (mass %) | | | | | |
|---|---|---|---|---|---|---|
| No. | C | Si | Al | Mn | S | N |
| A | 0.0020 | 3.6 | 0.30 | 0.3 | 0.0015 | 0.0020 |
| B | 0.0030 | 3.6 | 0.10 | 0.5 | 0.0024 | 0.0015 |
| C | 0.0025 | 3.6 | 0.01 | 0.2 | 0.0021 | 0.0025 |

The balance is Fe and incidental impurities

[Table 2]

TABLE 2

| Material No. | $W_{10/400}$ (W/kg) | TS average (MPa) | 2σ (MPa) |
|---|---|---|---|
| A | 34 | 668 | 42 |
| B | 39 | 659 | 51 |
| C | 32 | 665 | 30 |

Based on Table 2, for any of the above-listed conditions, the average tensile strength of the steel sheet was 650 MPa or more, which is a high strength as compared to a normal electrical steel sheet. Nevertheless, the variation could not be considered small. For material with a small amount of Al of 0.01%, however, a steel sheet with a certain yet small variation in the tensile strength was observed. The iron loss was also the lowest for that steel sheet.

In the present invention, the variation in tensile strength is considered small if 2σ is 15 MPa or less. The reason is that conventionally (PTL 11), variation is considered to be small if 2σ is 25 MPa or less, and therefore if 2σ is 60% of that value, i.e. 15 MPa or less, variation can be considered sufficiently small as compared to a conventional approach.

Next, the inventors inferred that when using a non-recrystallized microstructure, i.e. in a method that, at the time of final annealing, terminates annealing at an intermediate stage of the recrystallization that is in progress, reducing the components other than Si insofar as possible decreases variation in the resulting microstructure and also decreases variation in the tensile strength.

Therefore, the inventors prepared steel slabs with a chemical composition including Si: 3.7%, S: 0.0030% or less, and N: 0.0030% or less, with the Al amount varied in a range of 0.0001% to 0.01% and the Mn amount varied in a range of 0.01% to 0.2%.

The steel slabs were heated at 1100° C., then hot rolled to yield hot-rolled sheets with a thickness of 2.0 mm. The sheets were then subjected to hot band annealing at a temperature of 950° C. Next, the sheets were subjected to pickling, then cold rolled to a sheet thickness of 0.35 mm and subsequently subjected to final annealing at a temperature of 750° C.

Ten JIS 5 tensile test pieces for each material were collected from the resulting steel sheets in the direction orthogonal to the rolling direction, and a tensile test was performed. The variation was assessed in terms of the standard deviation σ. The values of 2σ are plotted in FIG. 1.

FIG. 1 shows that when the Al content is 0.005% or less and the Mn content is 0.15% or less, variation in the tensile strength tends to be small. Even in the above ranges, however, variation is large for some test pieces, demonstrating that merely setting the Al and Mn contents to be in the above ranges does not succeed in making variation in tensile strength small.

The inventors therefore tested and examined, in detail, test pieces having large and small variation in tensile strength under the conditions of Al content of 0.005% or less and Mn content of 0.15% or less. As a result, the inventors discovered that for a material with a chemical composition with Mn content of 0.10% or less and S being 10 mass ppm or more and 30 mass ppm or less, S was partially segregated/concentrated in some samples. In such samples, the reduction in strength was particularly large.

The inventors considered the reason to be that in the case of regular Mn and S contents, a phenomenon occurs whereby MnS that precipitates after casting dissolves during slab reheating at 1100° C. and then precipitates again during hot rolling, whereas if the Mn content is small, as listed above, liquid phase FeS precipitates more easily, which results in partial concentration/segregation of S, thereby rendering that portion susceptible to cracking and resulting in variation in strength.

It was also observed that the amount of oxides present on the surface of a test piece after final annealing tends to increase with a decrease in Al content. The inventors believed that this is because if Al is contained in a large amount, a barrier effect obtained by the generation of Al oxides inhibits the generation of Si oxides, whereas if Al is contained in a small amount, such a barrier effect decreases. Therefore the oxidation of Si advances more easily, which results in more oxides produced in the surface of the sample.

The generation of oxides on the surface layer should be inhibited, as it causes a degradation in iron loss properties.

The inventors of the present invention thus reasoned that it would be possible to suppress the occurrence of the above-described phenomenon and to reduce variation in strength by adding a small amount of Ca and converting MnS to calcium sulfide (CaS) in order to reduce the amount of MnS that precipitates after casting. At the same time, the inventors considered that the hot rolling conditions and the final annealing conditions affect the form of inclusions and hence performed the following experiment.

A steel slab having the chemical composition shown in Table 3 was prepared. The steel slab was heated at 1100° C., and then hot rolled to yield hot-rolled sheets with a thickness of 2.0 mm while varying the finisher delivery temperature and the coiling temperature after completion of hot rolling. Next, the sheets were subjected to hot band annealing at a temperature of 950° C., then to pickling and subsequent cold rolling to a sheet thickness of 0.35 mm. Thereafter, the sheets were subjected to final annealing at a temperature of 750° C. while varying the hydrogen concentration and dew point.

[Table 3]

TABLE 3

| | Chemical composition (mass %) | | | | | | |
|---|---|---|---|---|---|---|---|
| No. | C | Si | Al | Mn | S | N | Ca |
| D | 0.0015 | 3.7 | 0.003 | 0.06 | 0.0027 | 0.0023 | 0.003 |

The balance is Fe and incidental impurities

Epstein test pieces were cut from each of the resulting steel sheets in the rolling direction and a direction orthogonal to the rolling direction to measure its magnetic properties. The magnetic properties were evaluated in terms of the L+C property. Ten JIS 5 tensile test pieces each were collected in the direction orthogonal to the rolling direction, and a tensile test was performed. For all of the conditions, the average tensile strength was 650 MPa or more, indicating a high strength as compared to a normal electrical steel sheet.

Figure 2:
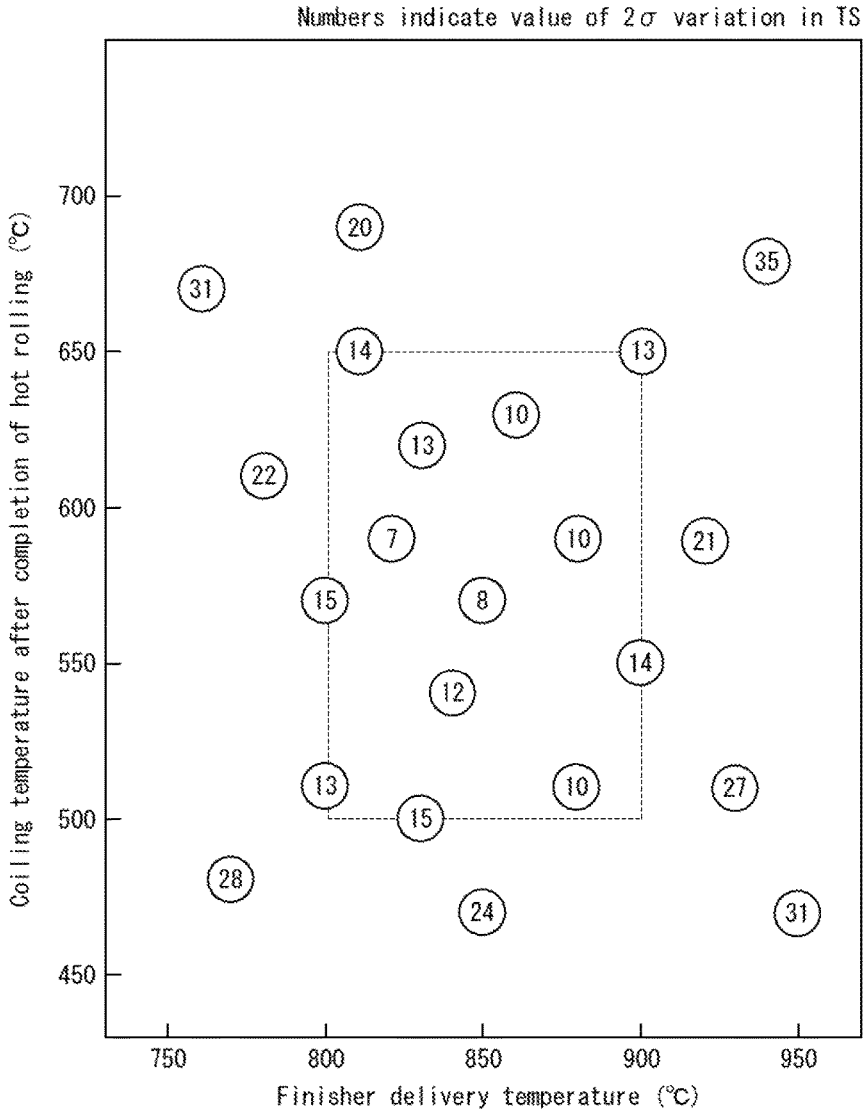
FIG. 2 is a graph showing the effect of hot rolling conditions on 2σ variation in tensile strength.

FIG. 2 is a graph showing the effect of hot rolling conditions on variation in tensile strength. FIG. 2 shows that under the conditions of a finisher delivery temperature of 800° C. or higher and 900° C. or lower and a coiling temperature after completion of hot rolling of 500° C. or higher and 650° C. or lower, variation was an extremely small value of 15 MPa or less.

Figure 3:
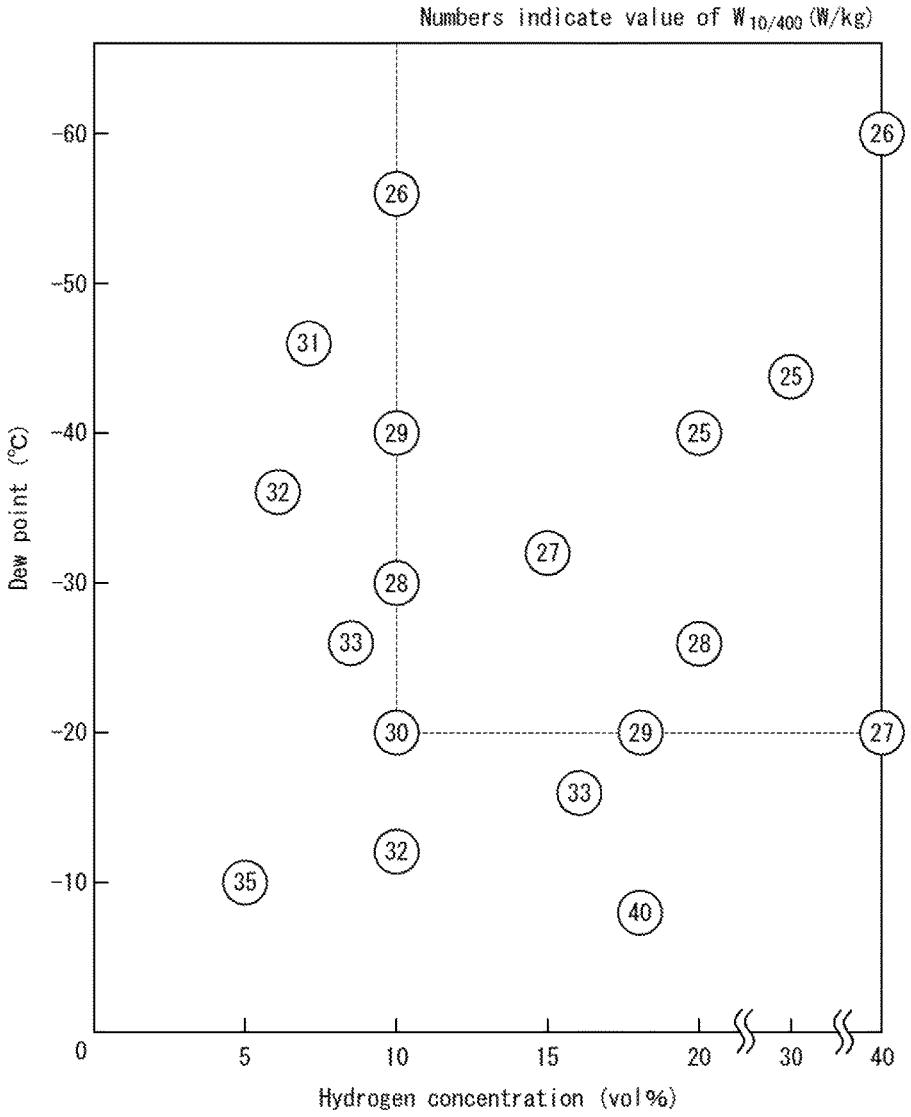
FIG. 3 is a graph showing the effect of final annealing conditions on iron loss.

FIG. 3 is a graph showing the effect of final annealing conditions on iron loss. FIG. 3 shows that under the conditions of a hydrogen concentration of 10 vol % or more and a dew point of −20° C. or lower, a low iron loss ($W_{10/400}$) of 30 W/kg or less was obtained.

For the samples having the above good iron loss properties and small variation in strength, the ratio of the non-recrystallized deformed microstructure was examined and found to be from 30% to 45%.

In the present invention, it is important to control the ratio of the non-recrystallized deformed microstructure in the steel microstructure. The method for calculating the ratio of the deformed microstructure was to cut out a cross section in the rolling direction of the steel sheet (ND-RD cross-section), polish and etch the cross section, and observe the cross section under an optical microscope to measure the area ratio of the non-recrystallized microstructure.

Next, the inventors performed an experiment to examine the effect of the Al and Mn contents in further detail.

The inventors prepared steel slabs with a chemical composition including Si: 4.0%, S: 0.0030% or less, and N: 0.0030% or less, with the Al amount varied in a range of 0.0001% to 0.01%, the Mn amount varied in a range of 0.01% to 0.20%, and the Ca amount varied in a range of 0.0010% or more to 0.0050% or less.

Each of the steel slabs was subjected to heating at a temperature of 1120° C. and then hot rolled, to yield hot-rolled sheets having a thickness of 1.8 mm, under the conditions of a finisher delivery temperature of 800° C. or higher and 900° C. or lower and a coiling temperature after completion of hot rolling of 500° C. or higher and 650° C. or lower. Next, the sheets were subjected to hot band annealing at a temperature of 975° C., then to pickling and subsequent cold rolling to a sheet thickness of 0.35 mm. Subsequently, the sheets were was subjected to final annealing at a temperature of 730° C. under the conditions of a hydrogen concentration of 10 vol % or more and a dew point of −20° C. or lower.

From each of the steel sheets obtained in this way, Epstein test pieces were cut in the rolling direction and a direction orthogonal to the rolling direction to measure its magnetic properties. The magnetic properties were evaluated in terms of the L+C property.

Figure 4:
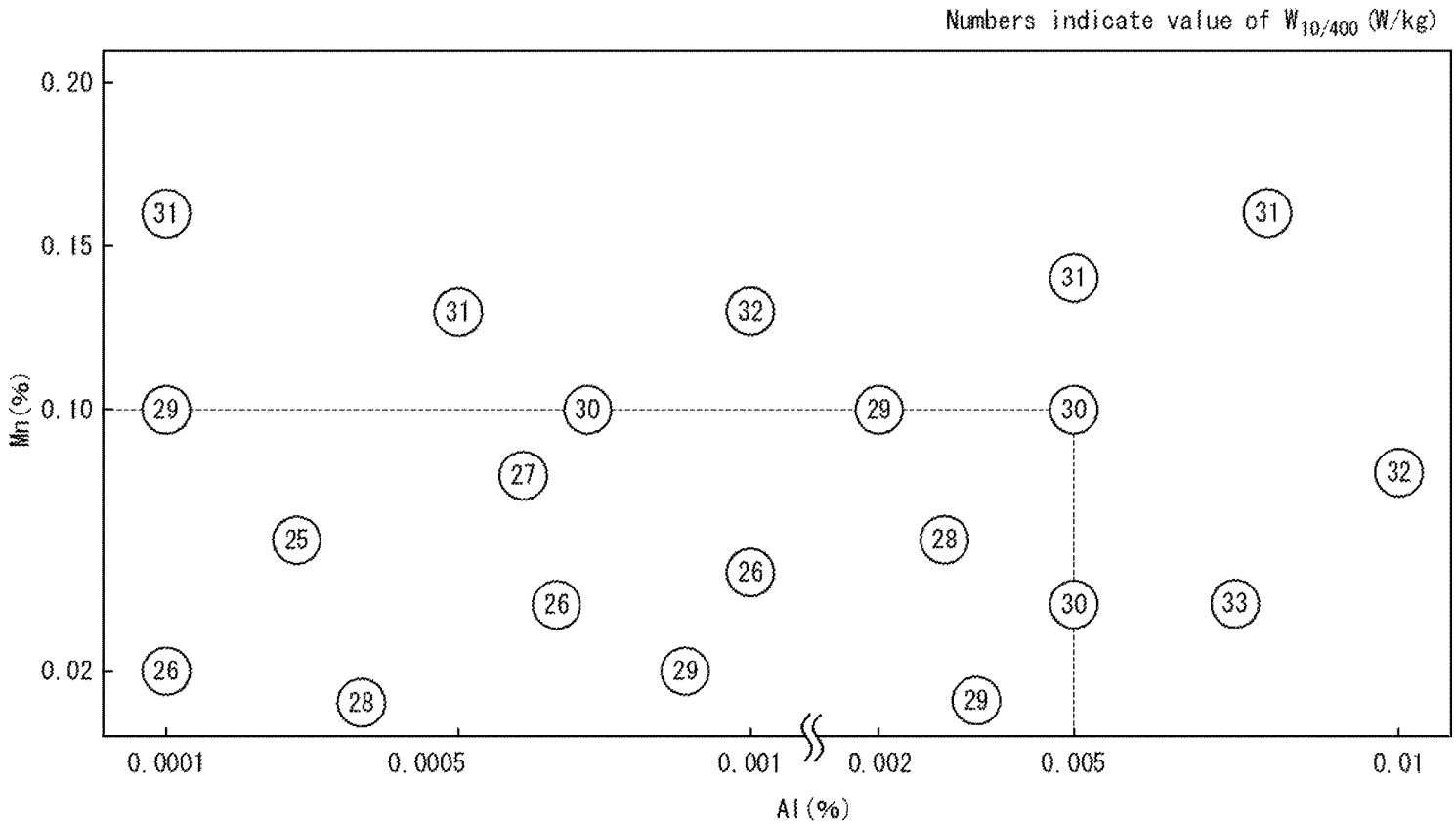
FIG. 4 is a graph showing the relationship between Al and Mn content and iron loss.

FIG. 4 shows the iron loss measurement results, demonstrating that an Al content of 0.005% or less and an Mn content of 0.10% or less yielded low iron loss ($W_{10/400}$ of 30 W/kg or less).

Ten JIS 5 tensile test pieces for each material were collected in the direction orthogonal to the rolling direction, and a tensile test was performed. The variation was assessed in terms of the standard deviation σ. The results for 2σ are plotted in FIG. 5. While not illustrated, for all of the conditions, the average tensile strength was 700 MPa or more, indicating an extremely high strength as compared to a normal electrical steel sheet.

Figure 5:
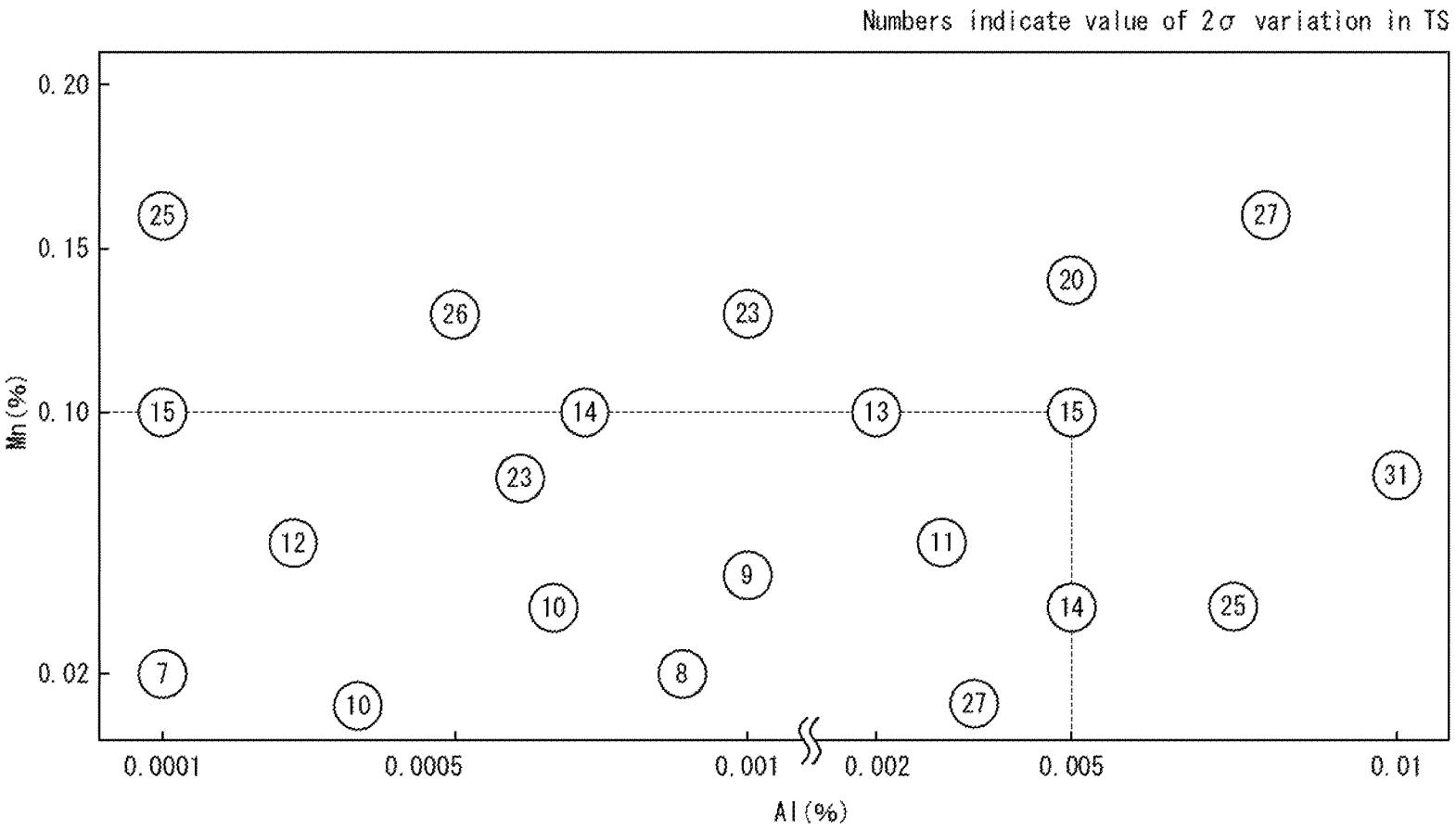
FIG. 5 is a graph showing the relationship between Al and Mn content and 2σ variation in tensile strength.

From FIG. 5, it is clear that many examples with a small variation are found when the Al content is 0.005% or less and the Mn content is 0.10% or less. As before, however, some examples had a large variation even within the above ranges. Examining these examples in detail, the inventors discovered that the Ca content was low as compared to the S content, i.e. that Ca/S was less than 0.80.

The ratio of the non-recrystallized deformed microstructure in the samples for which the iron loss properties were good and which were high strength with little variation was from 45% to 60%.

It thus became clear that a high-strength electrical steel sheet with low iron loss and little variation in strength can be obtained by using material with a chemical composition that includes C: 0.005% or less, Si: more than 3.5% and 4.5% or less, Mn: 0.01% or more and 0.10% or less, Al: 0.005% or less, Ca: 0.0010% or more and 0.0050% or less, S: 0.0030% or less, and N: 0.0030% or less, Ca/S being 0.80 or more, and the balance being Fe and incidental impurities.

At that time, it is necessary for the finisher delivery temperature to be 800° C. or higher and 900° C. or lower, the coiling temperature after completion of hot rolling to be 500° C. or higher and 650° C. or lower, and the final annealing to be performed in an atmosphere with a hydrogen concentration of 10 vol % or more and a dew point of −20° C. or lower.

With regard to the addition of Ca, JP 2001-271147 A (PTL 12) discloses a technique that allows for a reduction in iron loss even with many inclusions and precipitates by adding 10 ppm to 100 ppm of Ca to a chemical composition that includes C: 0.005% or less, (Si+Al)≥1.0%, Al≥0.2% or Al≤0.01%, Mn: 0.1% to 1.5%. P: 0.1% or less, S: 0.004% or less, and (Sb+Sn+Cu): 0.005% to 0.1%.

The invention in PTL 12 increases the grain size and improves iron loss properties in the product sheet by reducing the amount of Mn-based sulfides that inhibit the growth of grains at the time of final annealing, and converting such Mn-based sulfides to CaS. Hence, the objective and the effects differ from those of the present invention, in which the addition of Ca prevents precipitation of liquid-phase FeS and inhibits segregation/concentration of S, reducing variation in strength, in the case of low Mn content. Furthermore, in PTL 12, the example with the smallest Mn content is 0.15%, which does not overlap with the appropriate range for the Mn content in the present invention of 0.01% or more and 0.1% or less.

JP H11-293426 A (PTL 13) discloses a technique for producing a non-oriented electrical steel sheet with excellent fatigue properties by adding 0.0005% to 0.005% of Ca to a chemical composition including C: 0.005% or less, Si: 4.0% or less, Mn: 0.05% to 1.5%, P: 0.2% or less. N: 0.005% or less (including 0%), Al: 0.1% to 1.0%, and S: 0.0009% or less (including 0%). The invention in PTL 13, however, improves fatigue strength for a material containing S in an amount of 9 mass ppm or less by allowing the generation of dispersed spherical Ca—Al oxides by the addition of Ca. Accordingly, including Al in a range of 0.1% to 1.0% is considered important, and thus the objective and effects of adding Ca differ from those of the present invention. Furthermore, in PTL 13, the example with the smallest Mn content is 0.17%, which does not overlap with the appropriate range for the Mn content in the present invention of 0.01% or more and 0.1% or less.

Furthermore, the inventors of the present invention conducted the following experiment to investigate the influence of other manufacturing conditions.

The inventors prepared steel slabs having the chemical composition listed in Table 4, and after heating with varying the slab reheating temperature, the steel slabs were hot rolled, to yield hot-rolled sheets having a thickness of 1.6 mm, with the finisher delivery temperature being 870° C. to 890° C. and the coiling temperature after completion of hot rolling being 620° C. to 640° C. Then, the sheets were subjected to hot band annealing with changing the annealing temperature, then subjected to pickling and subsequent cold rolling to a sheet thickness of 0.25 mm. Thereafter, the sheets were subjected to final annealing at a temperature of 720° C. under the conditions of a hydrogen concentration of 20 vol % and a dew point of −40° C.

[Table 4]

TABLE 4

| | Chemical composition (mass %) | | | | | | |
|---|---|---|---|---|---|---|---|
| No. | C | Si | Al | Mn | S | N | Ca |
| E | 0.0012 | 3.55 | 0.0003 | 0.03 | 0.0008 | 0.0008 | 0.0011 |

The balance is Fe and incidental impurities

Epstein test pieces were cut from each of the resulting steel sheets in the rolling direction and a direction orthogonal to the rolling direction to measure its magnetic properties. The magnetic properties were evaluated in terms of the L+C property. Ten JIS 5 tensile test pieces each were collected in the direction orthogonal to the rolling direction, and a tensile test was performed. For all of the conditions, the average tensile strength was 600 MPa or more, indicating an extremely high strength as compared to a normal electrical steel sheet.

Figure 6:
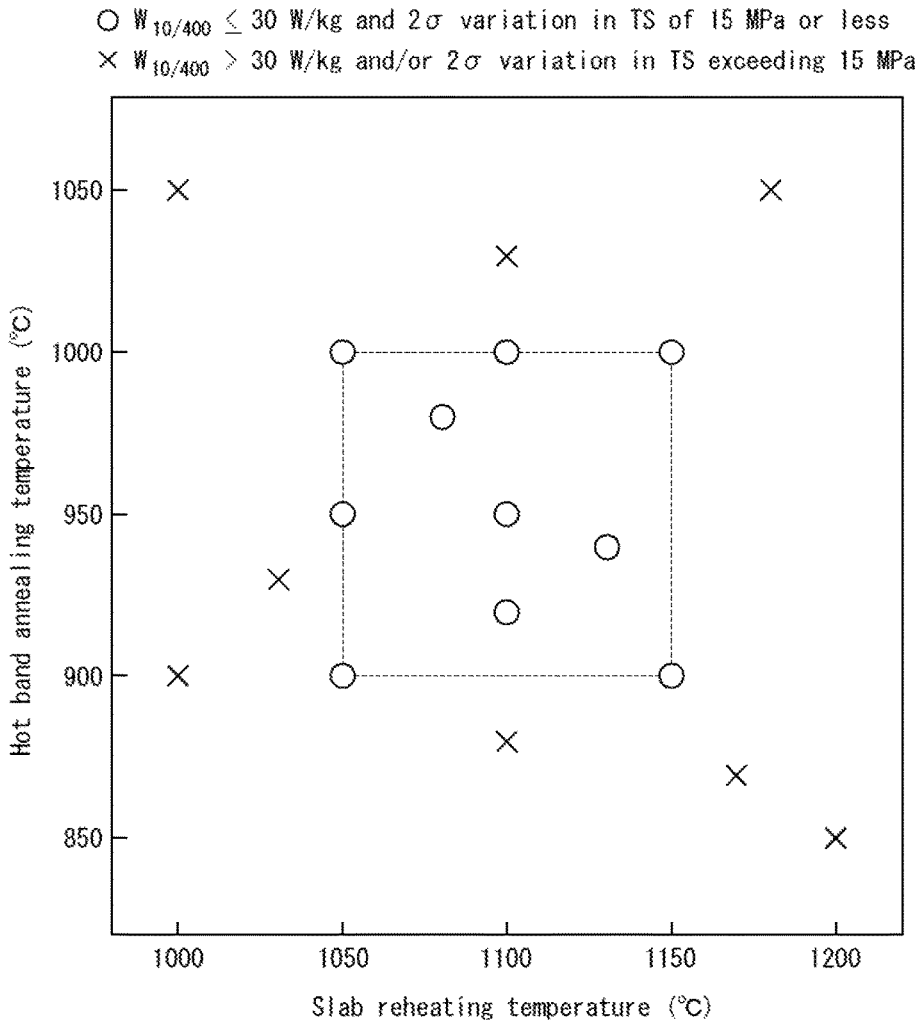
FIG. 6 is a graph showing the effect of the slab reheating temperature and the hot band annealing temperature on iron loss and 2σ variation in tensile strength.

FIG. 6 is a graph showing the effect of the slab reheating temperature and the hot band annealing temperature on iron loss and variation in tensile strength. It is clear that when the slab reheating temperature was 1050° C. or higher and 1150° C. or lower and the hot band annealing was performed at 900° C. or higher and 1000° C. or lower, low iron loss ($W_{10/400}$ of 30 W/kg or less) was obtained, and the variation in strength was low (15 MPa or less).

The reason why good properties are obtained at the slab reheating temperature within the above-described range is thought to be because a product that precipitated as MnS rather than CaS during casting dissolves and then precipitates as CaS. If the slab reheating temperature is low, MnS cannot redissolve, whereas if the heating temperature is high, a product that had already precipitated as CaS during casting ends up dissolving, yielding the reverse effect.

The reason why good properties are obtained at the hot band annealing temperature within the above-described range is thought to be because by adopting a hot-rolled sheet grain size of a suitable size, stain introduced into the steel sheet during cold rolling is suitably distributed on the micro level, thereby yielding a microstructure in which the recrystallized portion and the non-recrystallized deformed microstructure at the time of final annealing are suitably dispersed.

The ratio of the non-recrystallized deformed microstructure in the samples for which the iron loss properties were good and the variation in strength was small was from 55% to 70%.

It is thus clear that to obtain the electrical steel sheet of the present invention, it is necessary to set the slab reheating temperature to be 1050° C. or higher and 1150° C. or lower, and the hot band annealing to be 900° C. or higher and 1000° C. or lower.

Next, the inventors conducted an experiment to investigate the effect of the sheet thickness of the product sheet and the annealing temperature at the time of final annealing.

The inventors prepared steel slabs having the chemical composition listed in Table 5, and after heating the steel slabs at 1070° C., the steel slabs were hot rolled to yield hot-rolled sheets having a thickness of 1.6 mm, with a finisher delivery temperature of 830° C. to 850° C. and a coiling temperature after completion of hot rolling of 580° C. to 600° C. Next, the sheets were subjected to hot band annealing at a temperature of 900° C., then to pickling and subsequent cold rolling to a sheet thickness of 0.18 mm to 0.50 mm. Thereafter, the sheets were subjected to final annealing at a temperature range of 600° C. to 850° C. under the conditions of a hydrogen concentration of 30 vol % and a dew point of −30° C.

[Table 5]

TABLE 5

| No. | Chemical composition (mass %) | | | | | | |
|---|---|---|---|---|---|---|---|
| | C | Si | Al | Mn | S | N | Ca |
| F | 0.0034 | 4.2 | 0.0007 | 0.1 | 0.003 | 0.0027 | 0.0045 |

The balance is Fe and incidental impurities

Epstein test pieces were cut from each of the resulting steel sheets in the rolling direction and a direction orthogonal to the rolling direction to measure its magnetic properties. The magnetic properties were evaluated in terms of the L+C property. Ten JIS 5 tensile test pieces each were collected in the direction orthogonal to the rolling direction, and a tensile test was performed.

Figure 7:
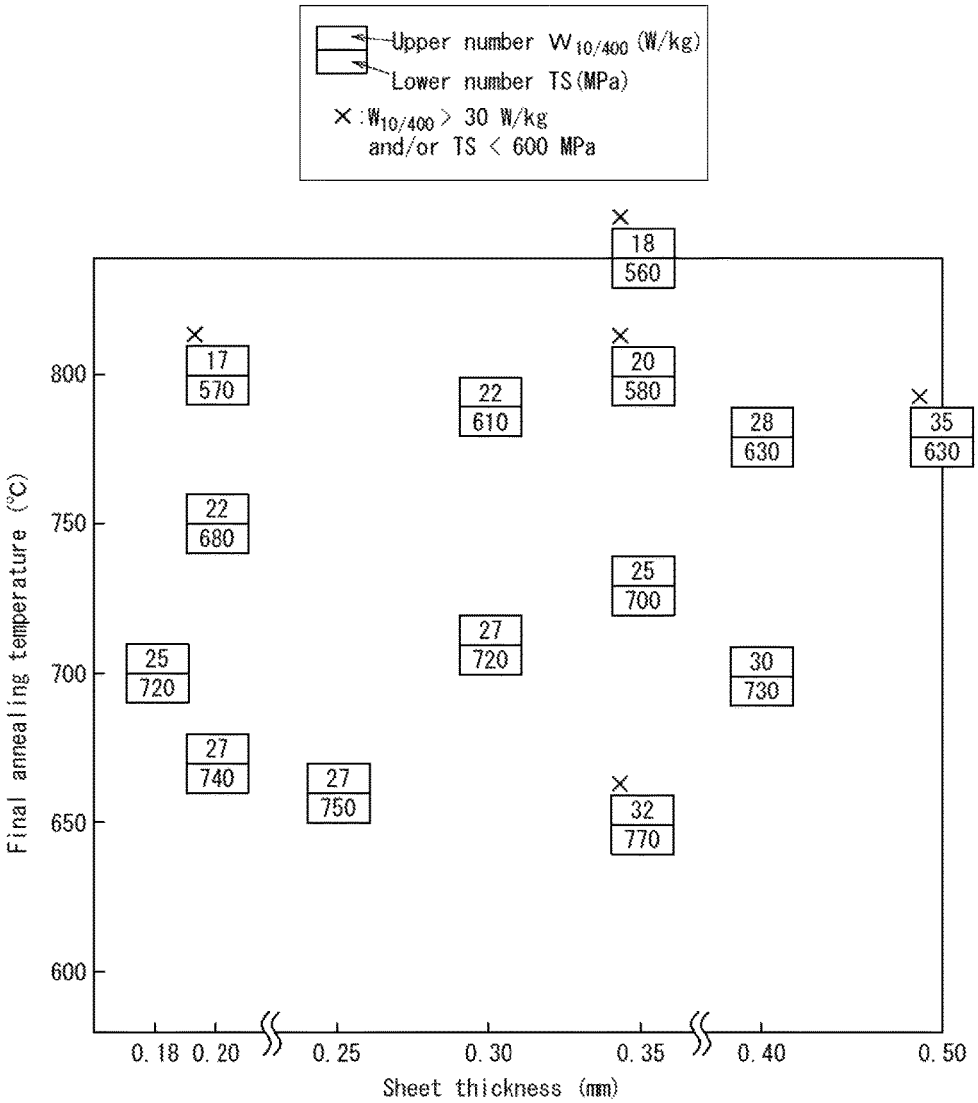
FIG. 7 is a graph showing the effect of the sheet thickness of the product sheet and the final annealing temperature on tensile strength and iron loss.

FIG. 7 is a graph showing the effect of the sheet thickness of the product sheet and the final annealing temperature on tensile strength and iron loss. FIG. 7 shows that when the annealing temperature was 800° C. or higher, the strength did not reach 600 MPa. At this time, the ratio of the non-recrystallized deformed microstructure was less than 10%. Furthermore, when the annealing temperature was 650° C. or lower, iron loss ($W_{10/400}$) exceeded 30 W/kg. At this time, the ratio of the non-recrystallized deformed microstructure exceeded 70%. Furthermore, upon the sheet thickness exceeding 0.40 mm, the properties of the strength being 600 MPa or more and iron loss ($W_{10/400}$) being 30 W/kg or less could not be obtained.

Accordingly, in the present invention, the sheet thickness is limited to 0.40 mm or less, and the annealing temperature at the time of final annealing is limited to being higher than 650° C. and lower than 800° C.

Next, the reasons for restricting the chemical composition of the steel to the above ranges are described.

C: 0.005% or Less

C has the effect of increasing strength due to carbide precipitates, yet C is not absolutely necessary, since strengthening of the steel sheet in the present invention is mainly achieved using solid solution strengthening of a substitutional element, such as Si, and a non-recrystallized and recovered microstructure. C in fact causes magnetic properties to deteriorate and has the large impact of reducing workability of high Si steel. Therefore, C content is limited to 0.005% or less and preferably 0.0035% or less.

Si: Over 3.5% and 4.5% or Less

Si is typically used as a deoxidizer for steel and also has the effect of increasing electrical resistance to reduce iron loss. Si is thus a primary element constituting a non-oriented electrical steel sheet. Since Si has a high solid solution strengthening ability as compared to other solid-solution-strengthening elements such as Mn. Al, and Ni that are added to a non-oriented electrical steel sheet, Si is the element that can best achieve a good balance among tensile strengthening, fatigue strengthening, and promotion of low iron loss. Accordingly, as the primary element for solid solution strengthening in the present invention. Si is actively added in a content exceeding 3.5%. Upon the Si content exceeding 4.5%, however, fatigue strength dramatically drops even though tensile strength increases, and the manufacturability decreases as more cracks form during cold rolling. Therefore, the upper limit on Si is 4.5%.

Mn: 0.01% or More and 0.10% or Less

As is the case with Si, Mn is an element that not only has an effect on increasing electrical resistance to reduce iron loss, but also serves to achieve solid solution strengthening of steel, and furthermore is effective for suppressing hot shortness. Hence, Mn is usually contained in a non-oriented electrical steel sheet in an amount of approximately 0.2% or more. However, in order to obtain a high-strength electrical steel sheet with low iron loss and little variation in strength, which is the aim of the present invention, it is essential to reduce the Mn content to 0.01% or more and 0.10% or less. This is a key point of the present invention.

Al: 0.005% or Less

As is the case with Si, Al is an element that is commonly used as a deoxidizer for steel and is selected as one of the main elements contained in a non-oriented electrical steel sheet, as it has a large effect on increasing electrical resistance to reduce iron loss. However, in order to obtain a high-strength electrical steel sheet with low iron loss and little variation in strength, which is the aim of the present invention, it is necessary to keep the amount of nitrides extremely low. Therefore, it is essential to set the Al content to 0.005% or less, which is a key point of the present invention.

Ca: 0.0010% or More and 0.0050% or Less

In the present invention, Ca is an element that is essential for obtaining good properties with less Mn content. If the Ca content is below 0.0010%, however, Ca does not provide a sufficient effect. On the other hand, if the Ca content exceeds 0.0050%, the effect of Ca reaches a saturation point and merely increases costs. Therefore, the Ca content is limited to the above range.

S: 0.0030% or Less

Upon the content of S exceeding 0.0030%, coarse MnS and CaS precipitates increase, leading to a reduction in fatigue strength or an increase in variation in tensile strength. It also becomes difficult to control the steel sheet microstructure to be suitable. Accordingly, the upper limit on S content is set to 0.0030%.

N: 0.0030% or Less

Like C described above, N causes magnetic properties to deteriorate and is therefore limited to a content of 0.0030% or less.

Ca/S: 0.80 or More

If Ca/S is less than 0.80, there is an insufficient amount of Ca for fixing S. Particularly, if Mn content is low, i.e. 0.01% or more and 0.10% or less, as is the case with the present invention. FeS in the liquid phase precipitates during slab reheating or the like, making S susceptible to segregation/concentration. Since this causes variation in strength, Ca/S needs to be limited to the above range. From the perspective of cost, Ca/S is preferably set to 3.0 or less.

The basic chemical composition of a non-oriented electrical steel sheet of the present invention has been described. Additionally, however, elements that have been conventionally used may be added as necessary for improvement of magnetic properties and for strengthening. Each added amount is preferably adjusted within a range that takes cost into consideration and does not reduce manufacturability. Specific examples are as follows.

Sb, Sn: 0.005% or More and 0.2% or Less

Both Sb and Sn have the effect of enhancing the texture and improving the magnetic properties of the non-oriented electrical steel sheet. To obtain this effect, it is necessary to add Sb and Sn in an amount of 0.005% or more each, whether these elements are added alone or in combination. On the other hand, excessive addition of Sb or Sn embrittles steel, and during manufacture of a steel sheet, induces sheet fracture and increases scabs. Therefore, the Sn content and Sb content are each set to 0.2% or less, whether added alone or in combination.

P: 0.01% or More and 0.2% or Less

P is extremely useful for strengthening since a significant solid solution strengthening ability is obtained with a relatively small added amount. Excessive addition of P, however, leads to embrittlement due to segregation of P, causing intergranular cracking in the steel sheet and deterioration in rollability. Therefore, the P content is limited to 0.2% or less. Note that P needs to be added in an amount of 0.01% or more to demonstrate a distinct effect of the solid solution strengthening ability. Therefore, the P content is set to the above range.

Mo: 0.005% or More and 0.10% or Less

Mo has the effect of improving surface characteristics by enhancing oxidation resistance. If the Mo content is below 0.005%, however, a sufficient effect is not obtained. Conversely, if the Mo content exceeds 0.10%, the effect reaches a saturation point and cost increases. Therefore, the upper limit on the Mo content is set to 0.10%.

B: 0.0002% or More and 0.002% or Less

B is an element that improves grain boundary strength through grain boundary segregation and particularly has a significant effect of suppressing embrittlement caused by grain boundary segregation of P. To obtain this effect, it is necessary to add B in an amount of 0.0002% or more. If the amount exceeds 0.002%, however, the effect attained by adding B reaches a saturation point, and thus the B content is limited to the above range.

Cr: 0.05% or More and 0.5% or Less

For a steel sheet containing Si as a primary component according to the present invention, Cr is effective for improving surface characteristics. This effect becomes apparent when Cr is added in an amount of 0.05% or more yet reaches a saturation point when the amount exceeds 0.5%. Hence, when Cr is added, the content is set to the above range.

By adopting the above-described essential components and suppressive components, variation in the precipitate conditions that affect crystal grain growth properties can be reduced, as can variation in mechanical properties of the product.

In the present invention, the elements other than those described above are Fe and incidental impurities. However, incidental impurities increase variation in mechanical properties of the product and are therefore preferably reduced to a non-problematic level in terms of manufacturing.

Next, the reasons for limiting the steel sheet microstructure in the present invention are described.

The high-strength electrical steel sheet of the present invention contains a mixed structure of recrystallized grains and non-recrystallized grains, yet it is important to control this microstructure appropriately.

First, it is necessary to control the area ratio of the deformed structure of non-recrystallized grains to be 10% or more and 70% or less within the steel sheet rolling direction cross section (cross section perpendicular to the sheet transverse direction) microstructure. When the non-recrystallized area ratio is less than 10%, sufficiently superior strength as compared to a conventional non-oriented electrical steel sheet can no longer be obtained. Conversely, upon the non-recrystallized ratio exceeding 70%, the strength is sufficiently high, yet low iron loss can no longer be obtained. More preferably, the non-crystallized ratio is from 15% to 65%.

Next, the reasons for limiting the conditions in a suitable method for manufacturing to obtain an electrical steel sheet according to the present invention are described.

The process for producing a high-strength electrical steel sheet according to the present invention may be implemented with the process and facilities used for general non-oriented electrical steel sheets. In the context of the present invention, an electrical steel sheet refers to a non-oriented electrical steel sheet.

For example, this process includes: subjecting steel, which is obtained by steelmaking in a converter or electric furnace to have a predetermined chemical composition, to secondary refining in a degasser; subjecting the steel to continuous casting or to blooming subsequent to ingot casting to be finished to a steel slab; hot rolling the steel slab to obtain a steel sheet; subjecting the steel sheet to hot rolled sheet annealing, pickling, cold or warm rolling, and final annealing: applying and baking an insulation coating to the steel sheet; and so on. In addition, direct casting may be used to directly produce a thin slab having a thickness of 100 mm or less.

In order to obtain the desired steel microstructure, it is important to control the manufacturing conditions of the steel sheet as described below.

First, when hot rolling a slab, it is necessary to control the slab reheating temperature to be 1050° C. or higher and 1150° C. or lower, and allow a sulfide precipitating as MnS rather than CaS during casting to assume a proper solute state. In other words, when the slab reheating temperature is lower than 1050° C., MnS cannot be dissolved, whereas upon the temperature exceeding 1150° C., a product that had already precipitated as CaS during casting ends up redissolving. Therefore, the slab reheating temperature needs to be limited to the above range.

Subsequently, hot rolling needs to be performed so that the finisher delivery temperature is 800° C. or higher and 900° C. or lower and the coiling temperature after completion of hot rolling is 500° C. or higher and 650° C. or lower. The reason is that by adopting these conditions, MnS that dissolved during slab reheating is converted to CaS without passing through the liquid phase of FeS.

Next, hot band annealing is performed, and the hot band annealing temperature at that time needs to be controlled to be 900° C. or higher and 1000° C. or lower. By performing the hot band annealing in this temperature range, it is thought that the hot-rolled sheet grain size becomes a suitable size, and that strain introduced into the steel sheet during cold rolling is suitably distributed on the micro level, thereby yielding a microstructure in which the recrystallized portion and the non-recrystallized deformed microstructure at the time of final annealing are suitably dispersed.

Next, the steel sheet is subjected to cold or warm rolling to finish to a final sheet thickness. At this time, the rolling reduction ratio is preferably set to exceed 75%. The reason is that at a ratio of 75% or lower, the recrystallization nuclei that are necessary for subsequent final annealing are insufficient, making it difficult to appropriately control the condition of dispersion of the non-recrystallized microstructure. Furthermore, the final sheet thickness needs to be 0.40 mm or less. The reason is that a thickness exceeding 0.40 mm makes it difficult for high-strength (600 MPa or more) to be compatible with low iron loss ($W_{10/400} \leq -30$ W/kg).

Next, the steel sheet is subjected to final annealing. The final annealing needs to be performed under an atmosphere with hydrogen of 10 vol % or more and a dew point of −20°

C. or lower, which is a strongly-reductive atmosphere, and with the annealing temperature in a range from over 650° C. to less than 800° C.

By adopting the above-described strongly-reductive atmosphere, it is thought that even for a chemical system with a low Al content and high Si content, as in the present invention, generation of oxides and the like on the surface layer of the steel sheet can be inhibited to a degree that does not induce deterioration of iron loss properties.

Additionally, when the annealing temperature is 650° C. or lower, the magnetic properties deteriorate significantly without sufficient recrystallization of the steel microstructure. Conversely, when the annealing temperature is 800° C. or higher, the non-recrystallized microstructure drops to less than 10%, causing a reduction in strength of the steel sheet.

Accordingly, in the present invention, the final annealing is performed under an atmosphere with hydrogen of 10 vol % or more and a dew point of −20° C. or lower, and with the annealing temperature in a range from over 650° C. to less than 800° C.

Of course, subsequent to the above-described final annealing, a known coating process may also be performed. In such a case, an organic coating containing resin is desirable for ensuring good punching properties, whereas applying a semi-organic or inorganic coating is desirable if weldability is of greater importance.

EXAMPLES

Example 1

Steel slabs having the chemical compositions listed in Table 6 were subjected, under the conditions listed in Table 7, to slab reheating, hot rolling, hot band annealing, and pickling, then cold rolling to a sheet thickness of 0.35 mm, and subsequently to a final annealing/coating process. At this time, for the samples after final annealing, a cross section in the rolling direction of the steel sheet (ND-RD cross section) was polished, etched, and observed under an optical microscope to calculate the area ratio of the non-recrystallized microstructure.

Epstein test pieces were cut from each of the resulting non-oriented electrical steel sheets in the rolling direction and the direction orthogonal to the rolling direction to measure its magnetic properties. The magnetic properties were evaluated in terms of the L+C property. Ten JIS 5 tensile test pieces for each condition were collected in the direction orthogonal to the rolling direction, and a tensile test was performed to examine the average tensile strength (TS) and the variation.

Table 7 lists the obtained results. Note that the variation in TS was assessed in terms of the standard deviation σ. Table 7 lists the value of 2σ. If the value of 2σ is within 15 MPa, the variation in TS can be considered small, as described above.

[Table 6]

TABLE 6

| | Chemical composition (mass %) | | | | | | | | | | | | | |
|---|---|---|---|---|---|---|---|---|---|---|---|---|---|---|
| No. | C | Si | Al | Mn | S | N | Ca | Sb | Sn | P | Mo | B | Ca/S | Notes |
| G | 0.0015 | 3.80 | 0.0100 | 0.08 | 0.0025 | 0.0023 | — | 0.03 | — | — | — | — | 0 | Comparative steel |
| H | 0.0030 | 3.55 | 0.0050 | 0.10 | 0.0030 | 0.0020 | 0.005 | — | 0.03 | — | 0.03 | — | 1.67 | Conforming steel |
| I | 0.0020 | 3.70 | 0.0010 | 0.08 | 0.0022 | 0.0017 | 0.003 | — | 0.05 | — | — | — | 1.36 | Conforming steel |
| J | 0.0010 | 3.85 | 0.0030 | 0.05 | 0.0007 | 0.0008 | 0.002 | — | 0.10 | 0.05 | — | 0.0005 | 2.86 | Conforming steel |
| K | 0.0040 | 4.20 | 0.0001 | 0.02 | 0.0012 | 0.0030 | 0.001 | 0.05 | — | — | — | 0.0003 | 0.83 | Conforming steel |

The balance is Fe and incidental impurities

[Table 7]

TABLE 7

| | | Hot rolling conditions | | | Hot band annealing | | Final annealing conditions | | |
|---|---|---|---|---|---|---|---|---|---|
| | | Slab | Finisher | | | | | | |
| No. | Type of steel | reheating temperature (° C.) | delivery temperature (° C.) | Coiling temperature (° C.) | Sheet thickness (mm) | Temperature (° C.) | Hydrogen concentration (° C.) | Dew point (° C.) | Annealing temperature (° C.) |
| 1 | G | 1200 | 875 | 625 | 2.0 | 1100 | 15 | −40 | 830 |
| 2 | G | 1100 | 830 | 600 | 2.2 | 1000 | 20 | −30 | 750 |
| 3 | G | 1000 | 720 | 500 | 2.2 | 950 | 5 | −10 | 660 |
| 4 | H | 1000 | 750 | 525 | 2.0 | 950 | 10 | 0 | 720 |
| 5 | H | 1100 | 850 | 600 | 1.8 | 975 | 20 | −40 | 750 |
| 6 | H | 1150 | 880 | 650 | 2.2 | 925 | 30 | −20 | 780 |
| 7 | I | 1125 | 925 | 700 | 2.2 | 950 | 5 | −30 | 660 |
| 8 | I | 1100 | 890 | 600 | 2.0 | 1000 | 25 | −50 | 680 |
| 9 | I | 1075 | 820 | 570 | 1.8 | 900 | 10 | −20 | 725 |
| 10 | J | 1200 | 900 | 630 | 1.4 | 1050 | 10 | −20 | 650 |
| 11 | J | 1050 | 800 | 550 | 2.4 | 1000 | 40 | −40 | 770 |
| 12 | J | 1150 | 900 | 650 | 1.6 | 900 | 20 | −60 | 670 |
| 13 | K | 1150 | 880 | 675 | 2.0 | 850 | 5 | −10 | 730 |

TABLE 7-continued

| | | | | | | | | | |
|---|---|---|---|---|---|---|---|---|---|
| 14 | K | 1125 | 880 | 630 | 2.0 | 900 | 20 | −40 | 790 |
| 15 | K | 1075 | 840 | 590 | 2.0 | 920 | 30 | −40 | 660 |

| | Product | Non-recrystallized | Product characteristics | | | |
|---|---|---|---|---|---|---|
| No. | sheet thickness (mm) | deformed microstructure area ratio (%) | TS average (MPa) | 2σ (MPa) | $W_{10/400}$ (W/kg) | Notes |
| 1 | 0.35 | 0 | 560 | 25 | 25 | Comparative example |
| 2 | 0.35 | 40 | 690 | 38 | 32 | Comparative example |
| 3 | 0.35 | 70 | 800 | 43 | 39 | Comparative example |
| 4 | 0.35 | 45 | 650 | 30 | 33 | Comparative example |
| 5 | 0.35 | 35 | 630 | 13 | 26 | Inventive example |
| 6 | 0.35 | 20 | 610 | 11 | 23 | Inventive example |
| 7 | 0.35 | 65 | 790 | 23 | 36 | Comparative example |
| 8 | 0.35 | 50 | 750 | 11 | 29 | Inventive example |
| 9 | 0.35 | 40 | 680 | 12 | 25 | Inventive example |
| 10 | 0.35 | 75 | 800 | 32 | 37 | Comparative example |
| 11 | 0.35 | 25 | 640 | 7 | 21 | Inventive example |
| 12 | 0.35 | 60 | 780 | 8 | 30 | Inventive example |
| 13 | 0.35 | 40 | 720 | 25 | 30 | Comparative example |
| 14 | 0.35 | 15 | 680 | 8 | 19 | Inventive example |
| 15 | 0.35 | 65 | 820 | 9 | 30 | Inventive example |

As is clearly shown in Table 7, the inventive examples satisfying the manufacturing conditions and the steel microstructure of the present invention (No. 5, 6, 8, 9, 11, 12, 14, and 15) each have small variation in TS and stable product characteristics.

By contrast, variation in TS was large in No. 1 to 3, which used steel sample ID G that was outside of the appropriate ranges of the present invention. Variation in TS was also large in No. 4, 7, 10, and 13, for which the slab reheating temperature, hot rolling conditions, final annealing atmosphere, and the like were outside of the appropriate ranges of the present invention.

Example 2

Steel slabs having the chemical compositions listed in Table 8 were subjected, under the various conditions listed in Table 9, to cold rolling to a sheet thickness of 0.18 mm to 0.50 mm and then subjected to a final annealing/coating process to manufacture non-oriented electrical steel sheets. As in Example 1, the magnetic properties (L+C property), as well as the average and variation of the tensile strength (TS) were examined for these steel sheets. Table 9 lists the results. Each assessment was made with the same method as an Example 1.

[Table 8]

TABLE 8

| | Chemical composite (mass %) | | | | | | | | | | | | | |
|---|---|---|---|---|---|---|---|---|---|---|---|---|---|---|
| No. | C | Si | Al | Mn | S | N | Ca | Sb | Sn | P | B | Cr | Ca/S | Notes |
| L | 0.0020 | 3.6 | 0.0007 | 0.06 | 0.0018 | 0.0022 | 0.0025 | — | 0.03 | — | — | — | 1.39 | Conforming steel |
| M | 0.0015 | 3.8 | 0.0010 | 0.04 | 0.0012 | 0.0020 | 0.0030 | — | 0.04 | 0.025 | — | — | 2.50 | Conforming steel |
| N | 0.0035 | 4.0 | 0.0020 | 0.08 | 0.0024 | 0.0015 | 0.0040 | — | 0.05 | — | 0.0004 | — | 1.67 | Conforming steel |
| O | 0.0030 | 4.3 | 0.00010 | 0.01 | 0.0015 | 0.0030 | 0.0012 | 0.1 | — | — | 0.0003 | 0.4 | 0.80 | Conforming steel |

The balance is Fe and incidental impurities

[Table 9]

TABLE 9

| No. | Type of steel | Slab reheating temperate (° C.) | Hot rolling conditions: Finisher delivery temperature (° C.) | Hot rolling conditions: Coiling temperature (° C.) | Hot band annealing: Sheet thickness (mm) | Hot band annealing: Temperature (° C.) | Final annealing conditions: Hydrogen concentration (vol %) | Final annealing conditions: Dew point (° C.) | Final annealing conditions: Annealing temperature (° C.) |
|---|---|---|---|---|---|---|---|---|---|
| 1 | L | 1100 | 850 | 600 | 2.0 | 950 | 20 | −40 | 750 |
| 2 | L | 1100 | 850 | 600 | 1.4 | 950 | 20 | −40 | 750 |
| 3 | L | 1050 | 820 | 500 | 1.8 | 980 | 20 | −40 | 735 |
| 4 | M | 1150 | 875 | 625 | 1.8 | 980 | 15 | −40 | 780 |
| 5 | M | 1125 | 875 | 625 | 1.6 | 980 | 25 | −50 | 700 |
| 6 | M | 1075 | 825 | 550 | 1.6 | 920 | 30 | −40 | 750 |
| 7 | N | 1200 | 925 | 675 | 1.8 | 950 | 5 | −10 | 680 |
| 8 | N | 1100 | 870 | 600 | 1.8 | 925 | 25 | −40 | 660 |
| 9 | N | 1075 | 850 | 600 | 1.8 | 925 | 35 | −30 | 700 |
| 10 | O | 1015 | 780 | 520 | 2.0 | 950 | 10 | −10 | 700 |
| 11 | O | 1075 | 825 | 625 | 2.0 | 925 | 20 | −40 | 660 |
| 12 | O | 1125 | 875 | 525 | 2.0 | 925 | 20 | −60 | 750 |

| No. | Product sheet thickness (mm) | Non-recrystallized deformed microstructure area ratio (%) | Product characteristics: TS average (MPa) | Product characteristics: 2σ (MPa) | Product characteristics: $W_{10/400}$ (W/kg) | Notes |
|---|---|---|---|---|---|---|
| 1 | 0.45 | 35 | 620 | 12 | 34 | Comparative example |
| 2 | 0.15 | 30 | 610 | 9 | 18 | Inventive example |
| 3 | 0.35 | 40 | 645 | 10 | 27 | Inventive example |
| 4 | 0.50 | 15 | 630 | 18 | 36 | Comparative example |
| 5 | 0.18 | 45 | 720 | 11 | 24 | Inventive example |
| 6 | 0.20 | 30 | 660 | 9 | 23 | Inventive example |
| 7 | 0.25 | 60 | 780 | 30 | 31 | Comparative example |
| 8 | 0.25 | 70 | 810 | 7 | 28 | Inventive example |
| 9 | 0.35 | 50 | 750 | 7 | 28 | Inventive example |
| 10 | 0.35 | 50 | 780 | 26 | 32 | Comparative example |
| 11 | 0.35 | 40 | 830 | 8 | 26 | Inventive example |
| 12 | 0.40 | 30 | 720 | 8 | 27 | Inventive example |

As is clearly shown in Table 9, the inventive examples satisfying the manufacturing conditions and the steel microstructure of the present invention (No. 2, 3, 5, 6, 8, 9, 11, and 12) each have small variation in TS and stable product characteristics.

By contrast, iron loss was large in No. 1 and 4, in which steel with a product sheet thickness exceeding 0.40 mm was used. Variation in TS was also large in No. 7 and 10, for which the slab reheating temperature, hot rolling conditions, final annealing atmosphere, and the like were outside of the appropriate ranges of the present invention.

INDUSTRIAL APPLICABILITY

According to the present invention, it is possible stably to obtain a high-strength non-oriented electrical steel sheet that, in addition to the obvious excellent magnetic properties, has excellent strength characteristics that exhibit little variation. This steel sheet can be suitably used as, for example, rotor material for a high speed motor.

The invention claimed is:

1. An electrical steel sheet, a chemical composition thereof comprising, by mass %, C: 0.005% or less, Si: more than 3.5% and 4.5% or less, Mn: 0.01% or more and 0.10% or less, Al: 0.005% or less, Ca: 0.0010% or more and 0.0050% or less, S: 0.0030% or less, and N: 0.0030% or less, Ca/S being 0.80 or more, the balance being Fe and incidental impurities, a sheet thickness being 0.40 mm or less, a non-recrystallized deformed microstructure being 10% or more and 70% or less, tensile strength (TS) being 600 MPa or more, and iron loss $W_{10/400}$ being 30 W/kg or less, wherein a variation in tensile strength (TS) of the electrical sheet in a direction orthogonal to a rolling direction is $2\sigma \leq 15$ MPa.

2. The electrical steel sheet according to claim 1, the chemical composition thereof further comprising, by mass %, at least one selected from the group consisting of Sb: 0.005% or more and 0.2% or less, Sn: 0.005% or more and 0.2% or less, P: 0.01% or more and 0.2% or less, Mo: 0.005% or more and 0.10% or less, B: 0.0002% or more and 0.002% or less, and Cr: 0.05% or more and 0.5% or less.

3. A method of producing an electrical steel sheet comprising a series of processes including heating and then hot rolling a slab having the chemical composition according to claim 1 to obtain a hot-rolled sheet, subsequently coiling and subjecting the sheet to hot band annealing and pickling, then performing cold or warm rolling to yield a sheet thickness of 0.40 mm or less, and then subjecting the sheet to final annealing;

a temperature during the heating of the slab being 1050° C. or higher and 1150° C. or lower, a finisher delivery temperature in the hot rolling being 800° C. or higher and 900° C. or lower, a temperature for the coiling being 500° C. or higher and 650° C. or lower, a temperature for the hot band annealing being 900° C. or higher and 1000° C. or lower, and the final annealing being performed in an atmosphere containing 10 vol % or more of hydrogen and having a dew point of −20° C. or lower, and in a temperature range from over 650° C. to less than 800° C.

4. A method of producing an electrical steel sheet comprising a series of processes including heating and then hot rolling a slab having the chemical composition according to claim 2 to obtain a hot-rolled sheet, subsequently coiling and subjecting the sheet to hot band annealing and pickling, then performing cold or warm rolling to yield a sheet thickness of 0.40 mm or less, and then subjecting the sheet to final annealing;

a temperature during the heating of the slab being 1050° C. or higher and 1150° C. or lower, a finisher delivery temperature in the hot rolling being 800° C. or higher and 900° C. or lower, a temperature for the coiling being 500° C. or higher and 650° C. or lower, a temperature for the hot band annealing being 900° C. or higher and 1000° C. or lower, and the final annealing being performed in an atmosphere containing 10 vol % or more of hydrogen and having a dew point of −20° C. or lower, and in a temperature range from over 650° C. to less than 800° C.

* * * * *